US008968123B2

(12) United States Patent
Query, Jr. et al.

(10) Patent No.: US 8,968,123 B2
(45) **Date of Patent: *Mar. 3, 2015**

(54) SOCCER GOAL SECURING APPARATUS AND METHOD

(75) Inventors: William Kress Query, Jr., Matthews, NC (US); Timothy Harold Wallace, Charlotte, NC (US); Larry Theodore Tucker, Oakboro, NC (US)

(73) Assignee: ABT, Inc., Troutman, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/791,700

(22) Filed: Jun. 1, 2010

(65) Prior Publication Data

US 2011/0098139 A1 Apr. 28, 2011

Related U.S. Application Data

(60) Provisional application No. 61/182,474, filed on May 29, 2009.

(51) Int. Cl.

| | |
|---|---|
| ***A63B 69/00*** | (2006.01) |
| ***A63B 63/00*** | (2006.01) |
| ***A63B 71/02*** | (2006.01) |
| *A63B 71/00* | (2006.01) |

(52) U.S. Cl.

CPC ..... *A63B 63/004* (2013.01); *A63B 71/028* (2013.01); *A63B 2071/009* (2013.01); *A63B 2210/50* (2013.01)

USPC ..... 473/478

(58) Field of Classification Search

USPC ..... 52/166, 149; 473/478, 477, 476, 415; 410/12

See application file for complete search history.

(56) References Cited

U.S. PATENT DOCUMENTS

| | | | | | |
|---|---|---|---|---|---|
| 665,757 | A | * | 1/1901 | Rynearson | 294/68.26 |
| 945,597 | A | * | 1/1910 | Prendergast | 52/20 |
| 949,066 | A | | 2/1910 | Fowler | |
| 2,449,600 | A | * | 9/1948 | Geiger | 410/100 |
| 3,127,042 | A | * | 3/1964 | Beckham | 414/477 |
| 3,263,853 | A | * | 8/1966 | Smith | 220/484 |
| 3,311,333 | A | * | 3/1967 | Galloway | 52/295 |
| 3,416,763 | A | * | 12/1968 | Moreno | 24/68 R |
| 3,550,343 | A | * | 12/1970 | Buske | 52/704 |
| 3,671,015 | A | * | 6/1972 | Sullivan | 254/332 |
| 3,717,963 | A | * | 2/1973 | Sauriol | 52/19 |

(Continued)

FOREIGN PATENT DOCUMENTS

| | | | |
|---|---|---|---|
| DE | 19844268 | A1 | 3/2000 |
| JP | 2003144595 | * | 5/2003 |

OTHER PUBLICATIONS

Webpage download, portable goal safety, SDAO, 2004, www.sdao.com/ref/Schools/soccer.../portable_goal_safety.pdf; 13 pages.*

(Continued)

*Primary Examiner* — Alvin Hunter
*Assistant Examiner* — M Chambers
(74) *Attorney, Agent, or Firm* — Moore & Van Allen PLLC

(57) ABSTRACT

Embodiments of the invention provide an apparatus for securing a movable soccer goal to a playing surface. When in use, the apparatus functions to prevent the soccer goal from being moved, thereby, making it considerably safer and more sturdy than an unsecured soccer goal.

16 Claims, 8 Drawing Sheets

(56) References Cited

U.S. PATENT DOCUMENTS

| | | | | |
|---|---|---|---|---|
| 3,817,473 | A * | 6/1974 | Board et al. | 242/381.1 |
| 3,848,367 | A * | 11/1974 | Barnes | 52/157 |
| 3,881,694 | A * | 5/1975 | Gardner | 24/68 R |
| 3,894,365 | A * | 7/1975 | Abbott | 52/23 |
| 4,243,350 | A * | 1/1981 | Hall | 410/100 |
| 4,453,659 | A * | 6/1984 | Torpey | 226/20 |
| 4,703,917 | A * | 11/1987 | Tomlinson | 254/369 |
| 4,842,458 | A * | 6/1989 | Carpenter | 410/3 |
| 5,273,292 | A | 12/1993 | Pardi et al. | |
| 5,282,706 | A * | 2/1994 | Anthony et al. | 410/100 |
| 5,295,664 | A * | 3/1994 | Kamper | 254/220 |
| 5,515,655 | A * | 5/1996 | Hoffmann | 52/126.6 |
| 5,586,768 | A | 12/1996 | Pavonetti | |
| 5,908,274 | A * | 6/1999 | Silberman | 410/10 |
| 6,007,053 | A * | 12/1999 | Huang | 254/247 |
| 6,082,697 | A | 7/2000 | Grunfeld | |
| 6,287,060 | B1 * | 9/2001 | Girardin | 410/7 |
| 6,402,643 | B1 | 6/2002 | Gill | |
| 6,406,230 | B1 * | 6/2002 | Mason et al. | 410/7 |
| 6,929,571 | B2 | 8/2005 | Jesch et al. | |
| 7,240,890 | B1 * | 7/2007 | Pellegrino | 248/503 |
| 7,331,880 | B2 * | 2/2008 | Rogers | 473/478 |
| 2005/0056378 | A1 * | 3/2005 | Schwertfeger | 156/584 |
| 2006/0199674 | A1 | 9/2006 | Rogers | |
| 2006/0202426 | A1 | 9/2006 | Tennett, Sr. | |
| 2007/0144081 | A1 * | 6/2007 | Caruso | 52/155 |
| 2007/0189873 | A1 * | 8/2007 | Breeden | 410/100 |
| 2009/0032671 | A1 * | 2/2009 | Perry et al. | 248/499 |
| 2011/0098140 | A1 * | 4/2011 | Query, Jr. | 473/478 |

OTHER PUBLICATIONS

AAE Installation Instructions, 2004, 1 page.*
AAE 2004 football catalog, 2004, 4 pages.*
Kwik Goal 2001 catalog, 2001, 2 pages.*
Machine translation of Patent DE19844268A1,Sep. 13, 2013, 3 pages.*
Webpage download of correspondence of application EP2265344,Sep. 13, 2013, 75 pages.*
International Search Report and the Written Opinion of the International Searching Authority mailed Mar. 5, 2009 for International Application PCT/US2009/040553.
European Patent Office; Extended European Search Report; Jul. 29, 2011; issued in European Patent Application No. 09732846.5.

* cited by examiner

SOCCER GOAL SECURING APPARATUS AND METHOD

CROSS-REFERENCE TO RELATED APPLICATIONS

This application claims priority from U.S. Provisional patent application No. 61/182,474, filed May 29, 2009 and entitled: "SOCCER GOAL SECURING APPARATUS AND METHOD", the contents of which are also hereby incorporated herein by reference.

FIELD

The invention generally relates to the field of sporting goal structures, and more particularly, embodiments of the invention relate to an apparatus for improving the safety of a movable soccer goal used on a field by securing the movable soccer goal to the ground and or a fixed object.

BACKGROUND

Playing fields, such as American-style football fields, are often used to play soccer. For example, a high school may have a football field that is surrounded by stands and other spectator facilities, but the school may not have such facilities for soccer. Building a separate soccer field having its own spectator facilities might not be considered an efficient use of a school's limited real estate and financial resources. Therefore, the high school may instead choose to use the football field or other field for soccer games and/or other purposes. To temporarily transition a field into a soccer field, movable soccer goals may be placed at each end of the field. Such movable soccer goals, however, are often prone to tip over, sometimes causing injury to players or others. This may be especially true when young children are playing on the field, as young children may be more pone to climb on, jump on, bump, or otherwise attempt to disturb the soccer goal.

Accordingly, there is a long-felt but unmet need to provide a system that enables facility personnel to quickly and easily anchor a movable goal on a field.

BRIEF SUMMARY OF EMBODIMENTS OF THE INVENTION

Embodiments of the invention address the need for an effective device to increase the safety and sturdiness of soccer goals or other types of objects without causing damage to playing fields or other surfaces. Furthermore, embodiments of the present invention can be used on any type of playing surface, either natural turf or an artificial playing surface, which can be indoors or outdoors, since at least some embodiments of the present invention are not limited to a particular playing surface to function properly.

More particularly, embodiments of the present invention relate to an apparatus that can secure a movable goal (e.g., a soccer goal) to a playing field or surface. For example, embodiments of the present invention provide a secure means of attaching the lower ground bar of a soccer goal to a housing secured into the ground and/or a football goal goalpost.

For example, embodiments of the invention provide an apparatus for securing a movable goal, where the apparatus comprises a securing device and a housing fixed to a playing surface. The securing device is capable of simultaneously and removably engaging an essentially horizontal member of the movable goal and the fixed housing. In one embodiment, the securing device is attached to the housing and a fixed vertical member, such as a vertical post of a football goal.

In one embodiment, the securing device includes a hook-shaped member for engaging the essentially horizontal member of the movable goal. In such an embodiment, the securing device may further include a pulling mechanism configured to pull the hook-shaped member to secure the essentially horizontal member between the hook-shaped member and the playing surface.

In one embodiment, the apparatus is configured such that no tools, other than those fixed to the apparatus, are required to engage or disengage the essentially horizontal member of the movable goal and the securing device extending from the playing surface. In some embodiments, the apparatus is structured to secure the goal by clamping the essentially horizontal member of the movable soccer goal between a portion of the securing device and the playing surface or a vertical post of the football goal.

Embodiments of the invention further provide an apparatus for securing a movable goal to a surface. The apparatus includes at least one securing member capable of engaging a structural member of the object and at least one mechanism is configured to substantially fix the securing member at a location of the surface to releasably secure the structural member of the object to the particular location Embodiments of the invention further provide an apparatus structured to secure a movable goal to a surface, where the goal has a horizontal bar. In one embodiment, the apparatus includes a housing, a goal holding portion, and a user-actuable mechanism for coupling the goal holding portion to the horizontal bar. The goal holding portion is coupled to the housing and extends to the horizontal bar to releasably engage the horizontal bar of the movable goal. The user-actuable mechanism is structured such that actuation of the mechanism pulls the goal holding portion toward the surface.

Embodiments of the present invention also provide a method comprising: (1) positioning a movable goal such that a structural member of the goal is located proximate to a housing secured in the ground; (2) positioning a goal securing apparatus proximate to the housing, the goal securing apparatus comprising a hook-shaped member; (3) attaching the hook-shaped member to the structural member of the goal; and (4) actuating a user-actuable mechanism of the goal securing apparatus to releasably secure the structural member to a particular location.

BRIEF DESCRIPTION OF THE DRAWINGS

Figure 1:
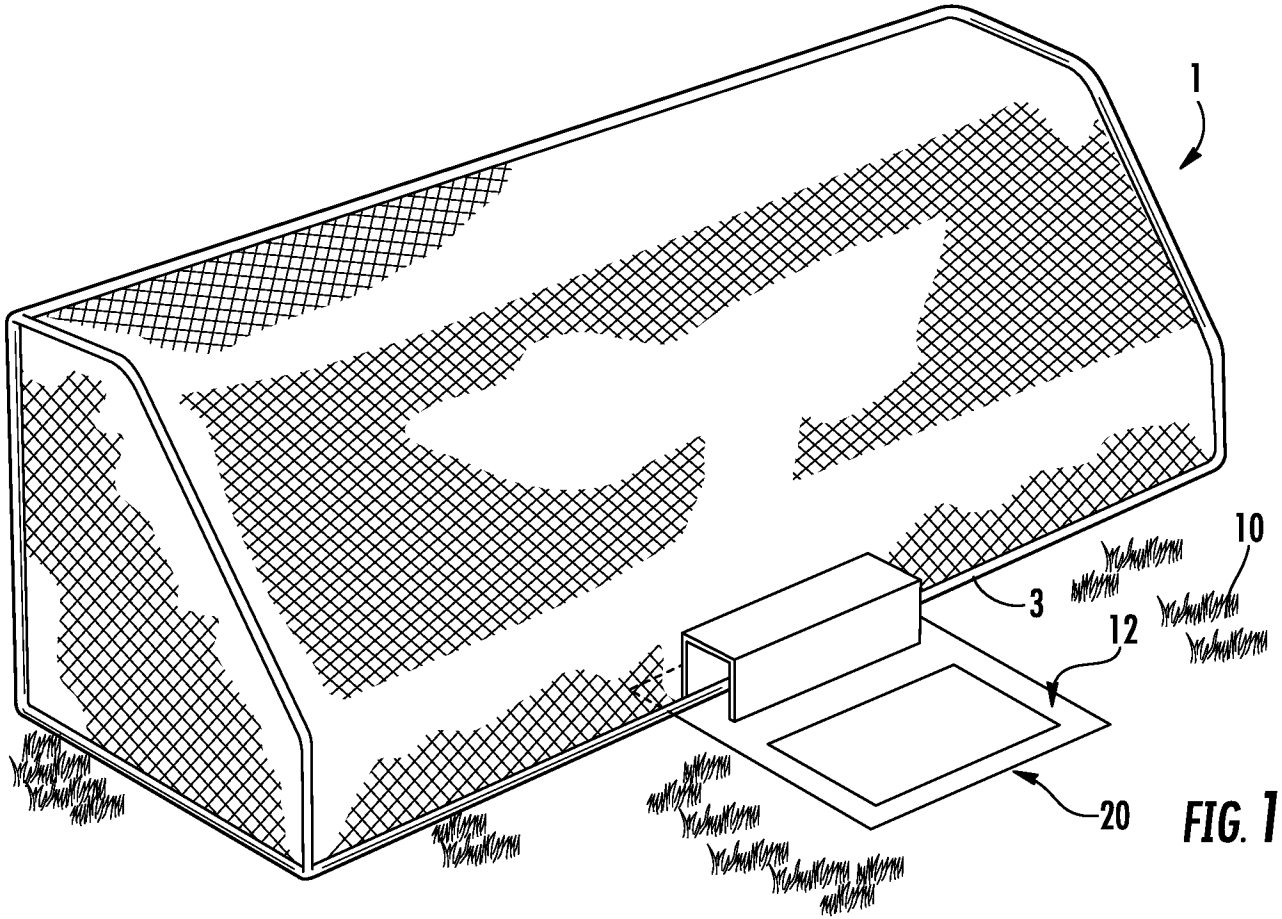
Figure 2:
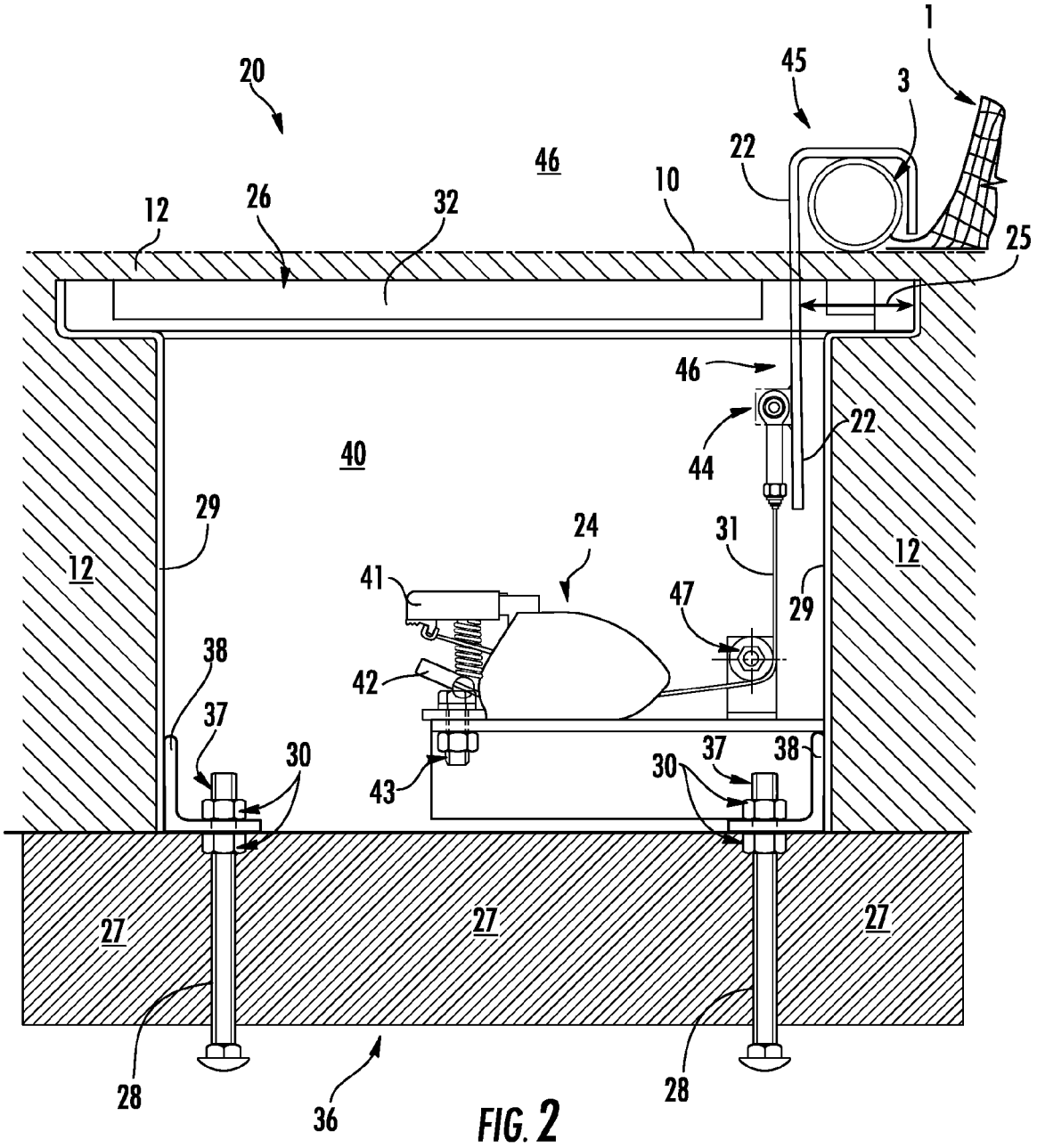
Figure 3:
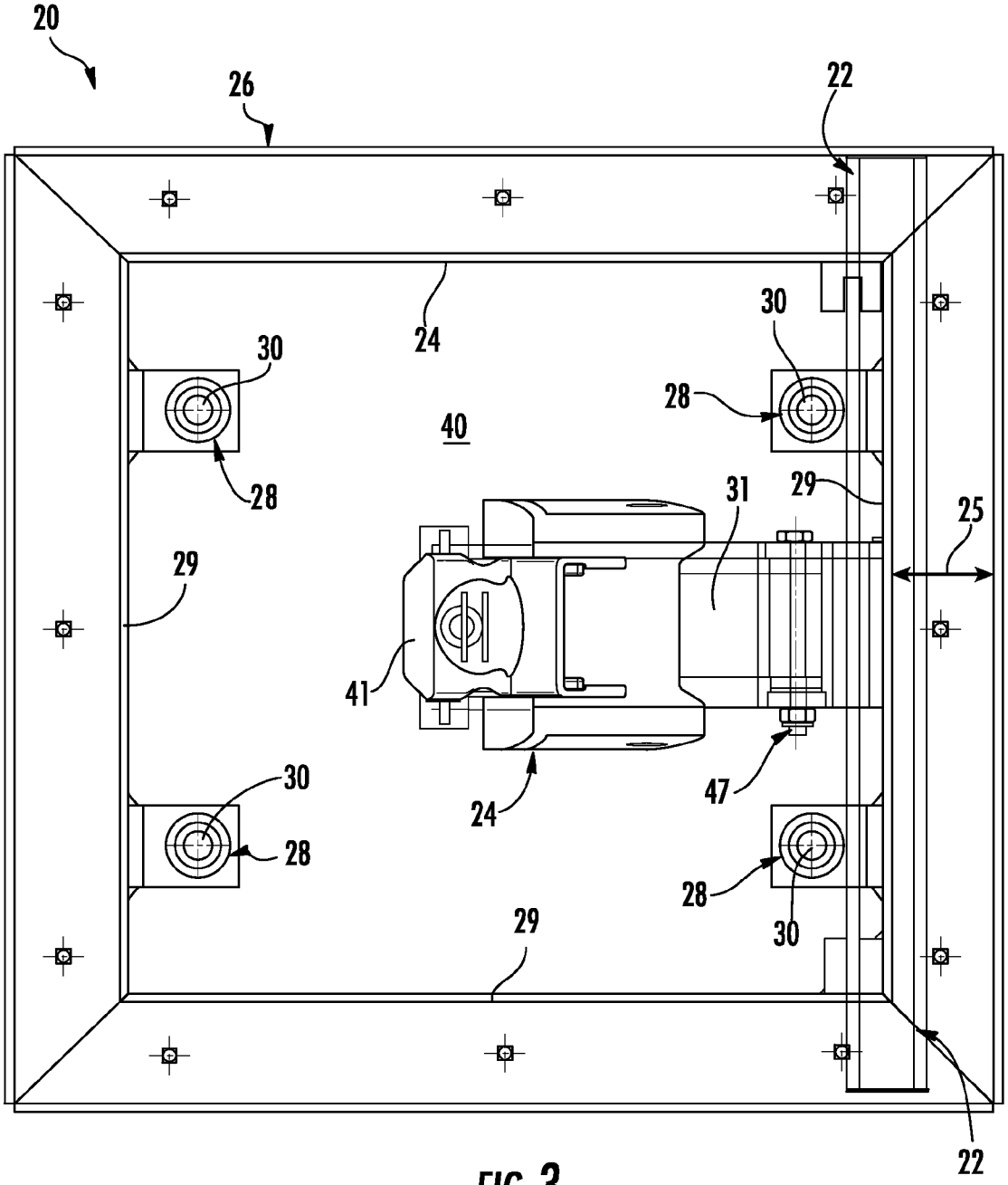
Figure 4A:
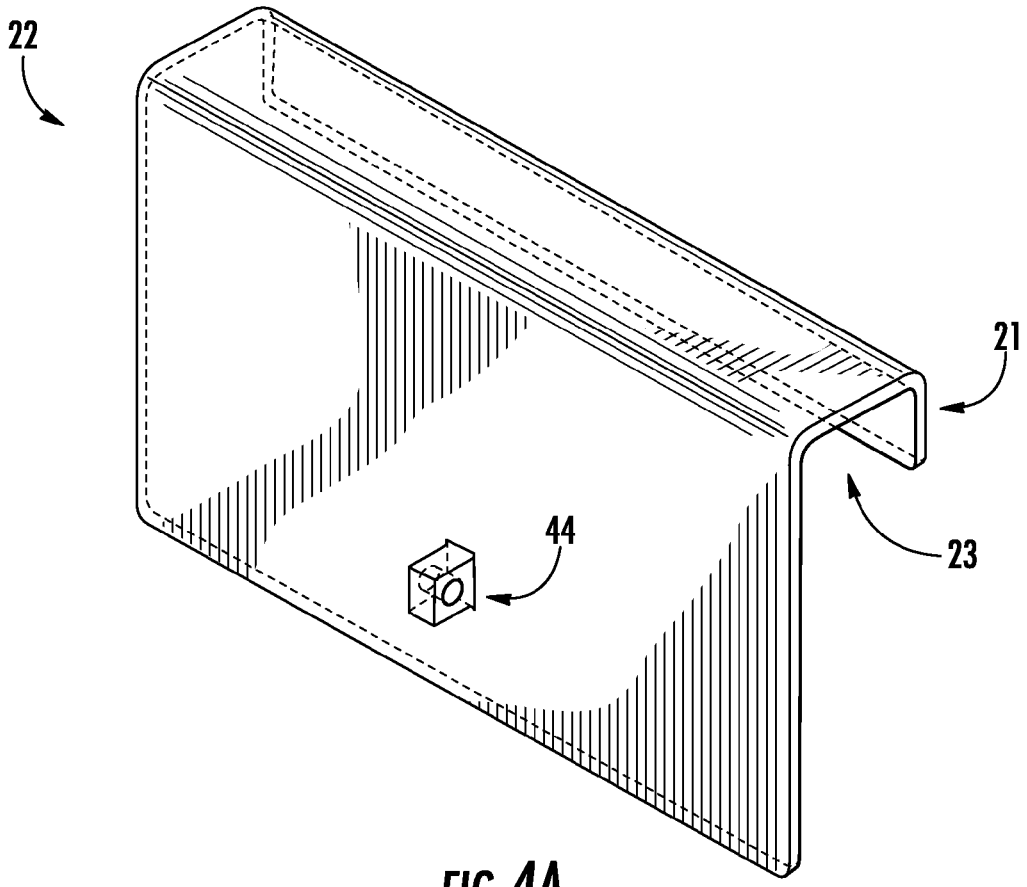
Figure 4B:
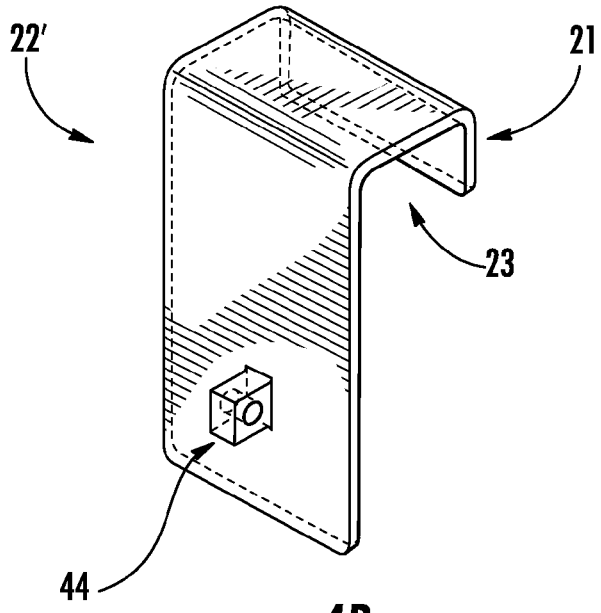
Figure 5:
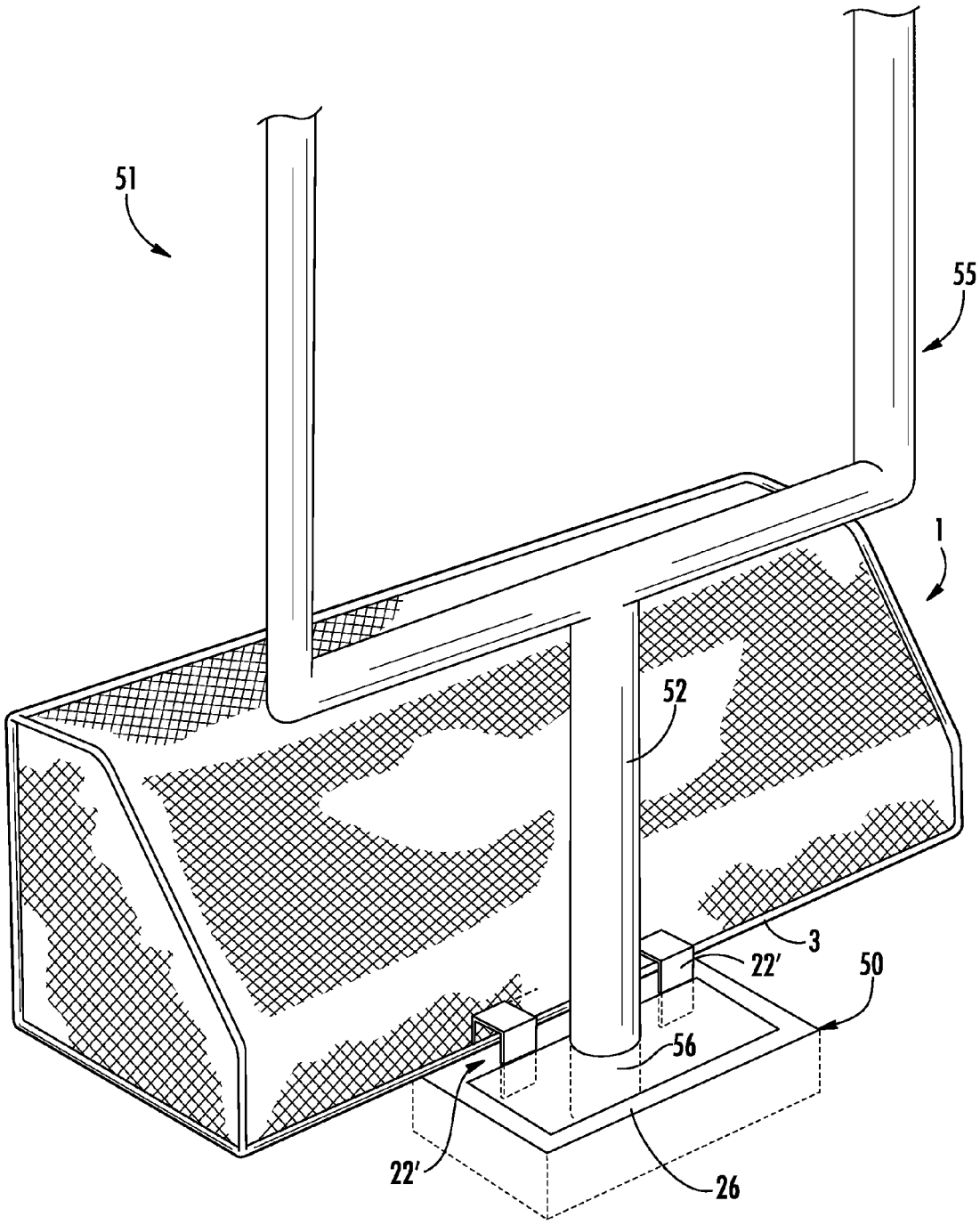
Figure 6:
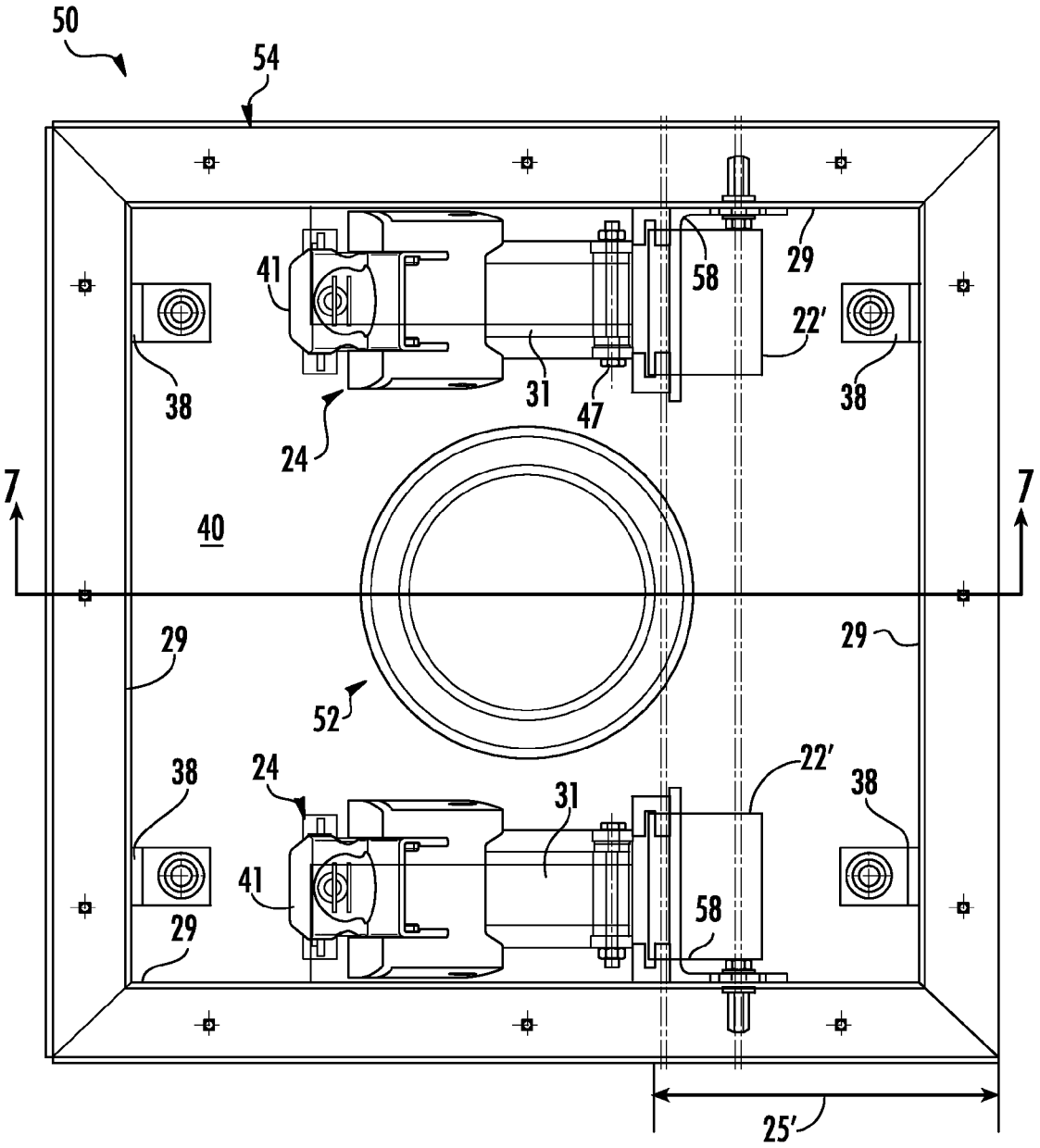
Figure 7:
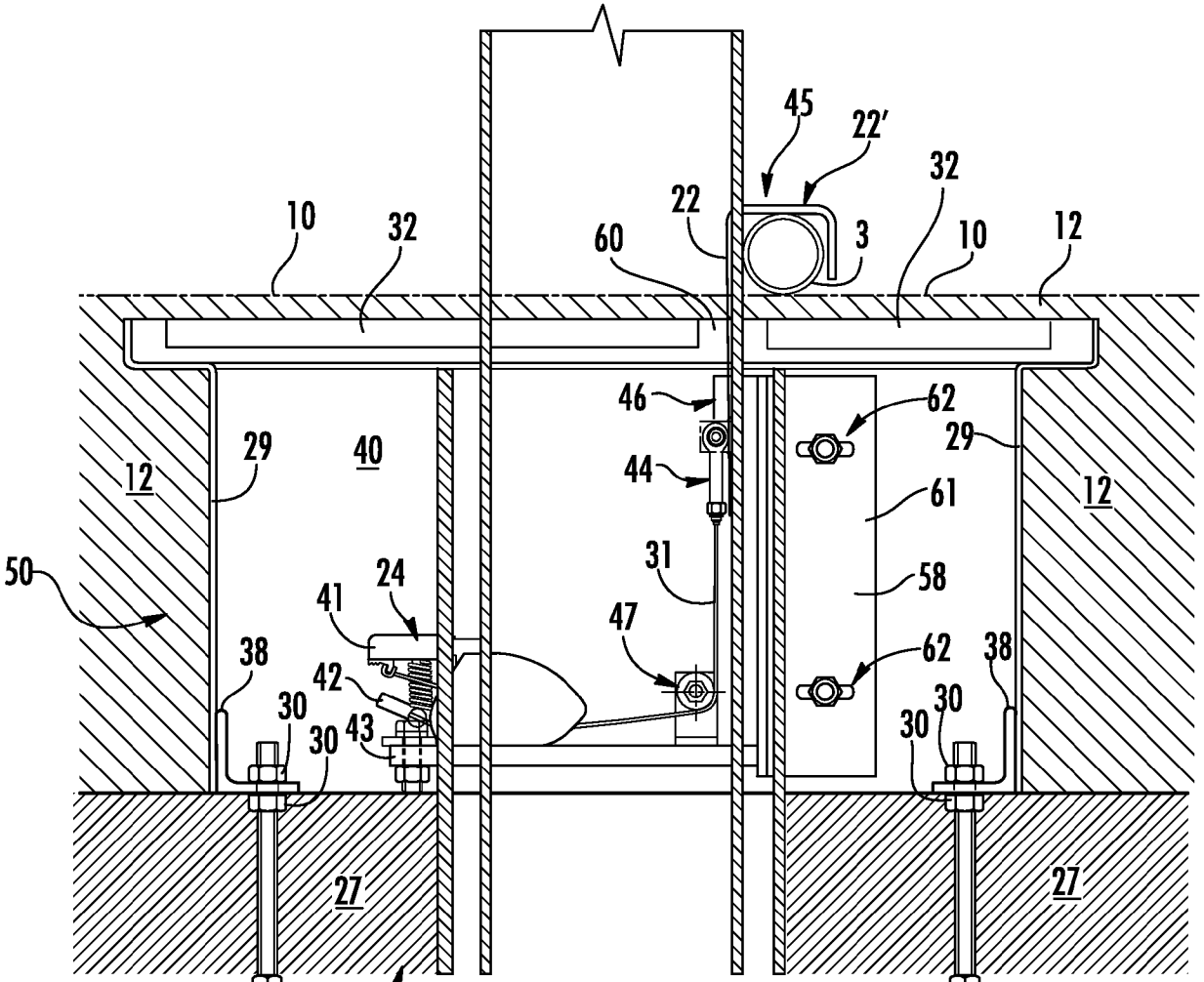
Figure 8:
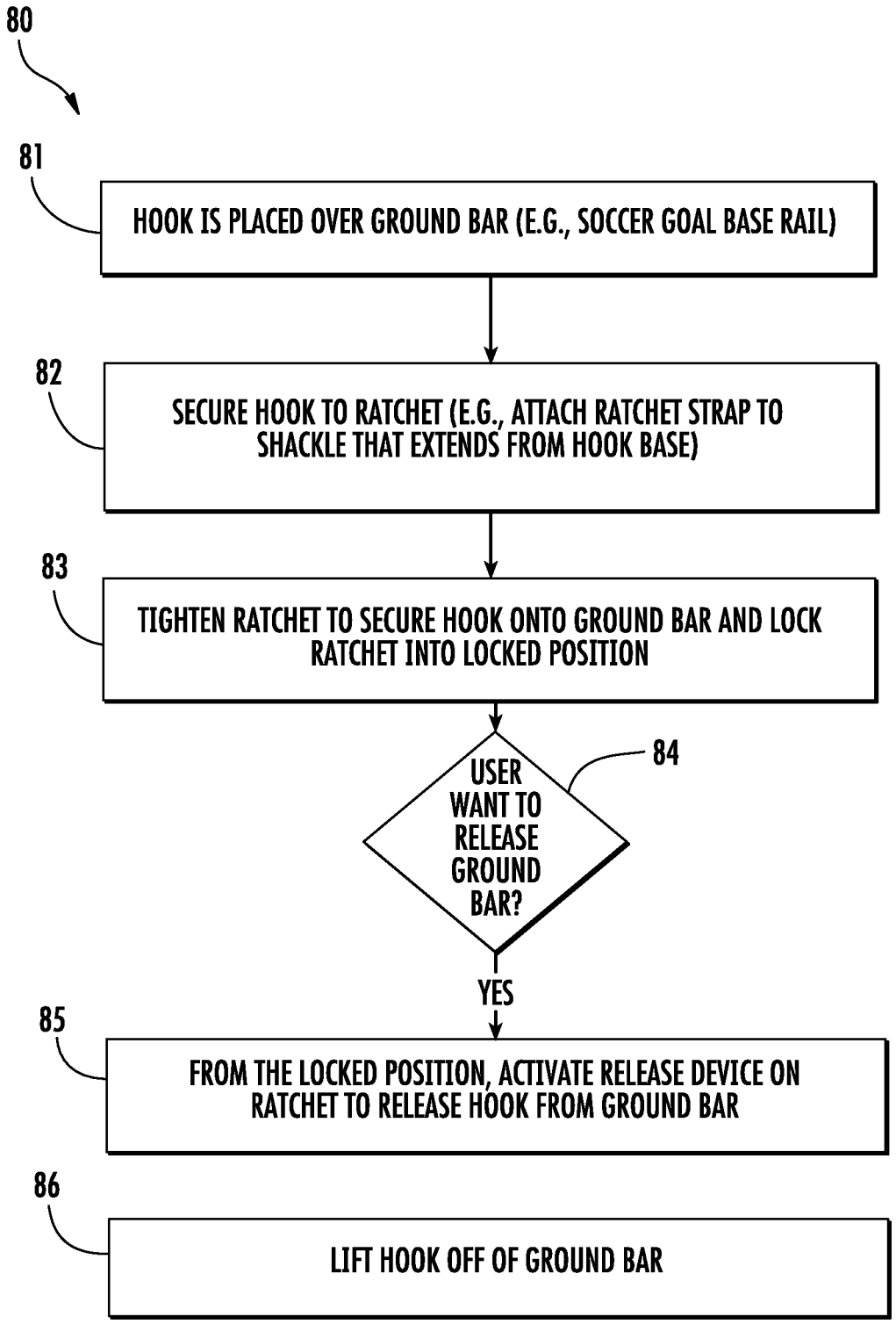

Having thus described embodiments of the invention in general terms, reference will now be made to the accompanying drawings, which are not necessarily draw to scale, and wherein:

FIG. 1 illustrates a perspective view of a soccer goal anchored using a soccer goal securing apparatus in accordance with an embodiment of the present invention;

FIG. 2 illustrates a side cross-sectional view of a soccer goal securing apparatus of FIG. 1, in accordance with an embodiment of the present invention;

FIG. 3 illustrates a top view of the soccer goal securing apparatus of FIG. 2, in accordance with an embodiment of the present invention;

FIGS. 4A and 4B (collectively FIG. 4) illustrates a perspective side view of a wide hook device and a narrow hook device of the goal securing apparatus of FIG. 1, in accordance with some embodiments of the present invention;

FIG. 5 illustrates a perspective view of a soccer goal anchored to a football goal using a soccer goal securing apparatus in accordance with another embodiment of the present invention;

FIG. 6 illustrates a top view of the soccer goal securing apparatus of FIG. 5, in accordance with an embodiment of the present invention;

FIG. 7 illustrates a cross-sectional view of a soccer goal securing apparatus of FIG. 6 taken along line 7-7, in accordance with an embodiment of the present invention; and FIG. 8 illustrates a method of anchoring a movable soccer goal in accordance with an embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a perspective view of a soccer goal 1 anchored to a playing field 10 using a soccer goal securing apparatus 20, in accordance with an embodiment of the present invention. More particularly, in the illustrated embodiment, the soccer goal securing apparatus 20 is configured to be anchored to a portion of the playing surface/ground 12 of the field 10. The soccer goal securing apparatus 20 is further configured to securely hold the horizontal ground bar 3 of the soccer goal 1 at the same time that the soccer goal securing apparatus 20 is secured to the ground 12.

As illustrated in FIG. 1, the soccer goal securing apparatus 20 is positioned at the ground 12 or other playing surface. In this way, the soccer goal securing apparatus 20 anchors the soccer goal's ground bar 3 to the field 10 at ground level, while remaining easily accessible to facility personnel who are charged with moving the soccer goal 1 on and off of the field 10. It should be noted that, although the embodiments of the present invention generally describe securing the ground bar 3 of the soccer goal 1 to the ground, in other embodiments, a similar apparatus and similar techniques may be applied to securing any soccer-like goal to any other object. For example, in one embodiment, a moveable goal (e.g., soccer goal, lacrosse goal, etc.) or other object may be secured to the vertical post of a football goalpost, as is described later with regards to FIGS. 5-6. In another exemplary embodiment, an indoor soccer goal or floor hockey goal may be secured to a gym floor, to the vertical post of a basketball hoop or to another surface or object.

It should be understood embodiments of the present invention may be employed to secure any type of goal, such as a soccer goal, lacrosse goal, hockey goal, basketball goal, and the like. Furthermore, objects other than goals, such as chairs, signage, or any other object(s), may be secured using various embodiments of the present invention. It should be further understood that the goal or other object may be secured to any surface, such as a football field, soccer field, other field, other outdoor surfaces, indoor surfaces (e.g., basketball court, indoor turf, floor, etc.) or any other surface.

FIGS. 2-3 illustrate a cross-sectional side view and a top perspective view, respectively, of a soccer goal securing apparatus 20 positioned in the ground 12 and securing the ground bar 3 of a soccer goal 1 to the ground 12 of a field 10, in accordance with an exemplary embodiment of the present invention. As such, the soccer goal securing apparatus 20 generally comprises a hook 22 (FIG. 4A) for releasably holding the ground bar 3 of a soccer goal 1 and one or more ratcheting systems 24 for engaging the hook 22. The ratchets 24 allow for engaging/disengaging the hook 22 with the ground bar 3, as will be discussed in more detail later. In one exemplary embodiment, the soccer goal securing apparatus 20 is configured such that a user can engage and/or disengage the soccer goal's ground bar 3 and hook 22 without the use of any tools not already coupled to some portion of the soccer goal securing apparatus 20.

In the embodiment illustrated in FIGS. 2-3, the soccer goal securing apparatus 20 comprises a housing 26 that is configured to be positioned in the ground 12. The housing 26 includes sidewalls 29 and a lid 32 to cover an opening 34 in the box member 26. The housing 26 also includes one or more openings to support one or more hooks 22. The housing 26 may further include a lip portion 25 that extends outward from a sidewall 29 of the housing 26. In one embodiment, the lip portion 25 is a portion of the housing 26 that extends a predetermined distance away from the hook 22 such that the lip portion 25 will be disposed underneath the ground bar 3 of the goal 1. The lip portion 25 and the sidewalls 29 are composed of a substantially rigid material and have a substantial surface area.

The housing 26 is secured to the ground 12 so that the lid 32 may be slightly below the ground surface, as illustrated in FIG. 2. In one embodiment, the housing 26 is secured to the ground 12 so that the lid 32 is substantially flush with the ground surface 10. In order to install the housing 26 in the ground 12, concrete 27 may be poured into a hole in the ground 12 and one or more fasteners 28 may be embedded in the concrete to provide a foundation 36 for the housing 26 to be secured to. For example, as illustrated in FIG. 2, a concrete foundation 36 is laid in the ground 12 and fasteners 28 are embedded therein with the threaded portions 37 pointed upwards so that the housing 26 may be secured to the fasteners 28 with one or more nuts 30. One or more L-brackets may be attached to the sidewalls 29 and the fasteners 28 to provide further stability.

In order to secure the ground bar 3 with respect to the housing 26, the soccer goal securing apparatus 20 further includes a mechanism to draw the ground bar 3 toward the lip portion 25 so that the ground bar 3 is secured between the lip portion 25 of the housing 26. The securing mechanism may be any device which can draw the ground bar 3 toward the playing surface 10. In the illustrative embodiments, the securing mechanism may be one or more ratchets 24 secured within the interior 40 of the housing 26.

Each ratchet 24 may include a series of internal gears (not shown) to tighten a variable-length strap 31 extending from the ratchet 24. A lever 41 on the ratchet 24 allows for tightening of the strap 31 and a release valve 42 or other device is operable to loosen the tension on the strap 31. The ratchet 24 may be mounted to sidewalls 29 and/or the foundation 36 of the housing 26 via one or more fasteners 43 or any other device. It should be understood that any other device capable of tightening and loosening tension on the strap 31 may be employed and the present invention should not be limited to the ratchet 24 described herein. The strap 31 may be any device to connect two objects, such as a cable, a rope, a belt, and the like.

The ratchet 24 attaches to the hook 22 by attaching the strap 31 to the hook 22. The hook 22 has a top portion 45 and a base portion 46. The top portion of the hook 22 is configured to receive and secure the soccer goal's ground bar 3. The base portion of the hook 22 is configured to be located within the interior 40 of the housing 26 and has a shackle portion 44 to removably attach a portion of the strap 31 thereto. The hook 22 extends through an opening in the sidewall 29 of the housing 26 to the exterior 46 of the housing 29 so that the top portion 45 of the hook 22 extends above ground level 10. In one embodiment, the hook 22 may be altogether removable from the housing 26 or retractable into the interior 40 of the housing 22. To that extent, when the securing apparatus 20 is not in use, the securing apparatus 20 does not pose any harm to other and may be hidden within the ground 12.

The hook 22 may be any device to substantially immobilize the soccer goal's ground bar 3. The hook 22 may have any shape or size and/or one or more fasteners or other devices to facilitate immobilization of the soccer goal's ground bar 3 or securing the soccer goal's ground bar 3 to the housing 26. The hook 22 is guided via two U-shaped guides which allow vertical movement of the hooks 22 at the same time of not allowing horizontal movement of the hooks 22.

A rotatable pulley 47 may be disposed between the ratchet 24 and the hook 22 to assist with guiding and tightening of the strap 31. The pulley 47 may be rotateable to facilitate movement of the strap 47. The pulley 47 allows for the strap 31 that extends horizontally from the ratchet 24 to be vertically disposed to the hook 22. As illustrated in FIG. 2, any horizontal forces to or from the ratchet 24 will translate to equivalent vertical forces on the hook 22. This allows for the ratchet 24 to be installed horizontally within the interior 40 of the housing 26 for ease of access.

The soccer goal securing apparatus 20 may be accessible through the lid 32 of the housing 26. The lid 32 may be removable so that the ratchet 24, ratchet strap 31, the hook 22, and/or other parts of the securing apparatus 20 are accessible to an operator of the securing apparatus 20. It should be noted that FIG. 2 illustrates the goal securing apparatus 20 with the lid 32 installed and FIG. 3 illustrates the goal apparatus 20 without the lid 32 and a view into the interior 40 of the housing 26.

FIGS. 4A and 4B (collectively FIG. 4) illustrates a perspective side view of the hook device 22. 22' of the goal securing apparatus 20 of FIG. 1, in accordance with some embodiments of the present invention. FIG. 4A illustrates a wide hook as implemented in FIG. 1 while FIG. 4B illustrates a narrow hook 22' which is illustrated as implemented in FIG. 5. In one embodiment, the narrow hook 22' may be employed in situations where multiple ratchets 24 are employed, as is further discussed later with regard to FIGS. 5-7.

In the illustrative embodiments of FIG. 4, at least one hook or hook-shaped member 22, 22' extends from the housing 26. The hook 22 can be used to engage the ground bar 3 by positioning the hook 22 around the ground bar 3. In one embodiment, the hook 22 forms a generally "C"-shaped member 21 having an interior 23 where the ground bar 3 can be secured thereto. It should be understood that the hook 22 may be other devices other than a "C"-shaped member, such as a fastener system (e.g., nut and bolt) to secure to a portion of the ground bar 3, a magnet, or any other device which will attach to or be integral with the ground bar 3. The hook 22 may extend from the housing 26 and/or a device within the interior 40 of the housing 26. For example, as illustrated in FIGS. 2-3, the hook 22 may extend from the ratchet 24, which is integrally formed with, welded to, or otherwise coupled to the interior of the housing 26. The hook 22 may be perpendicular to the playing surface 10 and a portion of the hook 22 may be secured to the housing 26. In this way, the hook 22 can simultaneously grasp the soccer goal's ground bar 3, while being fixed to the housing 26. In one embodiment, the ground bar 3 is generally cylindrical. In such an embodiment, the hook 22 may be configured to have an inside diameter that is only just slightly greater than the diameter of the ground bar 3.

As described above, in the illustrated embodiment, the hook 22 curves downwards toward the ground 12. Such a configuration may be preferable since it allows the ground bar 3 to be held close to the lip portion 25 of the housing 26, as is generally desirable, while the remainder of the soccer goal securing apparatus 20 remains slightly above the ground 12 where it can be more easily adjusted and manipulated by a user without significant interference from the ground 12. Furthermore, configuring the hook 22 to curve downwards makes it possible for a user to place the hook 22 over the ground bar 3 as opposed to requiring the user to lift the ground bar 3 over the hooks 22, which would be more difficult for a single person to accomplish. However, despite these potential advantages, in other embodiments of the present invention, the hook 22 may curve upwards towards the sky or may be of other configurations, as previously discussed.

By positioning the hook 22 around the ground bar 3, the open end of the hook 22 attaches to the ground bar 3. As previously mentioned, in order to secure the ground bar 3 within the hook 22 and in order to secure the soccer goal securing apparatus 20 with respect to the housing 26, the ratchet 24 or other securing mechanism functions to draw the hook-shaped member 22 toward the lip portion 25 so that the ground bar 3 is secured between the hooks 22 and the housing 26.

In some embodiments, the soccer goal securing apparatus 20 is made primarily of metal. However, in other embodiments, the soccer goal securing apparatus 20 may be made of any suitable polymeric or metallic material or any combination of these or other materials. In some other embodiments, portions of the soccer goal securing apparatus 20 may made of, lined with, or coated with relatively soft, flexible, and/or resilient material to protect the post 12 and/or the ground bar 3 from damage. For example, in one embodiment, the hook-shaped member 22 are coated with a rubber-like material or lined on the inside of the curvature with a foam or rubber-like material.

FIG. 5 illustrates a perspective view of a soccer goal 1 anchored to a football goal 51 using a soccer goal securing apparatus 50 in accordance with another embodiment of the present invention. More particularly, in the illustrated embodiment, the soccer goal securing apparatus 50 is configured to engage a lower portion of the vertical post 52 or gooseneck that supports the football crossbar and uprights 55. The soccer goal securing apparatus 50 is further configured to securely hold the horizontal ground bar 3 of the soccer goal 1 at the same time that the soccer goal securing apparatus 20 is engaged with the lower portion 56 of the vertical post 52 of the football goal 10.

FIGS. 6-7 illustrate a top perspective view and a side cross-sectional view, respectively, of the soccer goal securing apparatus 50 positioned around a vertical member 52 of a football goal 55 and securing the ground bar 3 of a soccer goal 1 to the football goal 55, in accordance with another embodiment of the present invention. FIG. 7 illustrates a cross-sectional view FIG. 6 taken along line 7-7. In FIGS. 6-7, the soccer goal securing apparatus 50 is similar to the soccer goal securing apparatus 20 previously described. For example, the soccer goal securing apparatus 50 generally releasably holds the ground bar 3 of a soccer goal 1 and comprises a housing 26 and one or more ratchets 24 for releasably engaging the ground bar 3. Each ratchet 24 generally includes one or more releasing mechanisms 42 to allow a hook 22' to release the soccer goal's ground bar 3. In one exemplary embodiment, the soccer goal securing apparatus 50 is configured such that a user can engage and/or disengage the soccer goal's ground bar 3 without the use of any tools not already coupled to some portion of the soccer goal securing apparatus 50.

In the embodiment illustrated in FIGS. 6-7, the housing 54 that is configured to be positioned around and secured to a vertical post 52 of a football goal 55. Secured to the housing 54 is one or more ratchets 24. In the illustrative embodiment, two ratchets 24 are employed on either side of the vertical post 52. Each ratchet 24 may be similar in function and design as the ratchet 24 previously described with regards to FIGS. 2-3. Nonetheless, each ratchet 24 may be secured to a sidewall 29 of the housing 54 via an L-bracket 58 or other type of fastener.

In one embodiment, the L-bracket 58 may include adjustable portions 62, such as elongated channels defined by the body 61 of the L-bracket 58, to allow the position and/or location of the ratchet 24 to be adjustable and moveable within the housing 26. For example, the L-bracket adjustable portions 62 allow each ratchet 24 and associated hook 22' to move forward and backward upon setting the football goal 55 to compensate for any installation alignment. To that extent, the ground bar 3 of the goal 1 can be pulled snug against the football goal 55 no matter where the vertical post 52 of the football goal 55 is located in the interior 40 of the housing 26.

Each ratchet 24 may be connected to a single unitary hook 22' or each ratchet 24 may be connected to separate individual hooks 22' so that a plurality of hooks 22' are secured to the ground bar 3. Thus, each ratchet 24 may be independently operated and attached to separate pulleys 47, straps 31 and hooks 22', as illustrated in FIG. 6.

In one embodiment, narrow hooks 22' (illustrated in FIG. 4B) are employed in securing the ground bar 3 of the goal 1. As illustrated in FIG. 6, the ratchets 24 are employed on either side of the vertical post 52 and each ratchet 24 employs a separate narrow hook 22'. As previously mentioned, the housing 26 may include a lip portion 25' which extends from and away the hook 22'. Each ratchet 24 draws each respective hook 22' toward the lip portion 25' of the housing 26 so that the ground bar 3 of the goal 1 is secured between the hooks 22' and the lip portion 25'. The lip portion 25' illustrated in FIGS. 6-7 indicates a portion of the lid 32 as part of the lip portion 25' such that the hooks 22' draw the ground bar 3 between the hooks 22' and the lid 32. The hooks 22' are allowed to be disposed through a portion 60 of the housing 26 between portions of the lid 32 as illustrated best in FIG. 7.

Embodiments of the present invention further provide a method of anchoring a movable goal. Such method will now be described. FIG. 8 illustrates a method 80 of anchoring a movable soccer goal in accordance with an embodiment of the present invention. Specifically, the method 80 may involve positioning a movable soccer goal such that a structural member of the soccer goal, such as the ground bar, is located proximate to a housing and/or a structural member (e.g., a vertical post) secured in the ground. As illustrated by block 81, one or more hooks of the soccer goal securing apparatus is positioned around the horizontal ground bar or other structural member of the soccer goal. As illustrated by block 82, the hook is secured to one or more ratchets, such as by attaching each respective ratchet strap to the shackle that extends from the base portion of each respective hook. In block 83, one or more ratchets of the soccer goal securing apparatus are tightened to draw the hook(s) into a locked position until the soccer goal's ground bar is secured against the playing surface and/or the housing. The ratchet is then locked into a locked position. If the user wants to release the ground bar in decision block 84, the method 80 continues to block 85 where the release device of the ratchet is activated while the ratchet is in the locked position. This releases the tension of hook on the ground bar and the hook may be detached from the ground bar, as illustrated in block 86.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. An apparatus for releasably securing a movable goal having a horizontal member relative to a playing surface, the apparatus comprising:

a housing fixed at least partially within a playing surface; and at least one securing device structured to releasably engage the horizontal member of the movable goal, the at least one securing device being mounted within the housing, and wherein the at least one securing device comprises:

at least one hook-shaped member for engaging the horizontal member of the movable goal; and at least one securing mechanism operatively connected to said goal engaging member, the at least one securing mechanism comprising at least one rotatable member being structured to rotate in a first direction and a second direction, the at least one securing mechanism being mounted entirely within said housing; and at least one elongate member extending between the at least one rotatable member and the at least one hook-shaped member; and wherein the at least one securing mechanism is structured so that rotation of the at least one rotatable portion in the first direction causes the at least one elongate member to be retrieved around the at least one rotatable member to thereby urge the at least one hook-shaped member toward and into the interior of the housing to thereby secure the horizontal member of the moveable goal to the playing surface.

2. The apparatus of claim 1, wherein the housing comprises a lip portion.

3. The apparatus of claim 2 wherein the at least one securing device is structured to secure the horizontal member of the movable goal by clamping the horizontal member of the movable goal between the hook-shaped member and the lip portion of the housing.

4. The apparatus of claim 2, wherein the lip portion is configured to support the horizontal member of the moveable goal when the moveable goal is secured by the hook-shaped member.

5. The apparatus of claim 2, wherein the upper surface of the lip portion is substantially flush with the playing surface.

6. The apparatus of claim 2, wherein the upper surface of the lip portion is recessed below the playing surface.

7. The apparatus of claim 1, wherein the location of the at least one securing device is adjustable within the interior of the housing.

8. The apparatus of claim 1, wherein the housing is secured to a vertical post of a football goal.

9. The apparatus of claim 1, wherein the at least one hook-shaped member comprises a plurality of hook-shaped members and the at least one securing mechanism comprises a plurality of securing mechanisms.

10. The apparatus of claim 1, wherein the at least one hook-shaped member is configured to be retractable below the playing surface.

11. The apparatus of claim 1, wherein the housing is secured into at least a portion of a foundation located underneath a portion of the playing surface.

12. The apparatus of claim 1, wherein the playing surface comprises a football field, soccer field, a lacrosse field, a hockey rink, a playground surface, a multipurpose playing field, an asphalt surface, a tennis court, an indoor surface, and a basketball court.

13. The apparatus of claim 1, wherein the at least one securing mechanism comprises a release mechanism for loosening the tension on the elongate member.

14. The apparatus of claim 1, wherein the at least one securing device comprises a rotatably pulley positioned between the at least one securing mechanism and the at least one hook-shaped member, the pulley mounted to the housing and structured to operably engage the elongate member so that the elongate member retrieves the hook-shaped member in a vertical direction within the housing.

15. A method for releasably securing a movable goal having a horizontal member relative to a playing surface, the method comprising:

providing a housing fixed at least partially within a playing surface; and providing at least one securing device operatively connected to the goal engaging member, the at least one securing device being mounted entirely within said housing and being structured to releasably engage the horizontal member of the movable goal, wherein the at least one securing device comprises:

at least one hook-shaped member for engaging the horizontal member of the movable goal; and at least one securing mechanism, the at least one securing mechanism comprising at least one rotatable member being structured to rotate in a first direction and a second direction; and at least one elongate member extending between the at least one rotatable member and the at least one hook-shaped member; and mounting the at least one securing device within the housing; and positioning the at least one hook-shaped member about the horizontal member of the moveable goal; and rotating the at least one rotatable portion in the first direction to retrieve the at least one elongate member around the at least one rotatable member to thereby urge the at least one hook-shaped member toward and into the interior of the housing to thereby secure the horizontal member of the moveable goal to the playing surface.

16. The method of claim 15, further comprising:

loosening the tension on the elongate member; and removing the at least one hook-shaped member from about the horizontal member of the moveable goal.

* * * * *